United States Patent [19]

Boily et al.

[11] Patent Number: 4,900,603

[45] Date of Patent: Feb. 13, 1990

[54] REFRACTORY, HEAT INSULATING ARTICLES

[75] Inventors: Michel S. Boily, Solihull; James Flood, Lichfield, both of United Kingdom

[73] Assignee: Foseco Trading A.G., Chur, Switzerland

[21] Appl. No.: 568,708

[22] Filed: Jan. 6, 1984

[30] Foreign Application Priority Data

Jan. 20, 1983 [GB] United Kingdom ..... 8301543

[51] Int. Cl.[4] ..... B05D 5/12; C21D 8/02

[52] U.S. Cl. ..... 428/77; 428/78; 428/67; 266/280; 266/283; 266/282; 266/286

[58] Field of Search ..... 428/67, 77, 78; 266/283, 280, 282, 286

[56] References Cited

U.S. PATENT DOCUMENTS

| | | | |
|---|---|---|---|
| 2,704,419 | 3/1955 | Hewitt et al. | 266/286 |
| 3,764,125 | 10/1973 | Horn et al. | 266/280 |
| 4,337,930 | 7/1982 | Daussan et al. | 52/593 |
| 4,623,131 | 11/1986 | Roberts | 266/280 |

FOREIGN PATENT DOCUMENTS

| | | |
|---|---|---|
| 30308 | 6/1981 | European Pat. Off. . |
| 0042767 | 12/1981 | European Pat. Off. . |
| 1939653 | 2/1971 | Fed. Rep. of Germany . |
| 1170666 | 1/1959 | France . |
| 805823 | 12/1958 | United Kingdom . |
| 1264202 | 2/1972 | United Kingdom . |
| 1326242 | 8/1973 | United Kingdom . |
| 1364665 | 8/1974 | United Kingdom . |
| 2080505 | 2/1982 | United Kingdom . |
| 2112374 | 7/1983 | United Kingdom . |

*Primary Examiner*—George F. Lesmes
*Assistant Examiner*—E. Cole
*Attorney, Agent, or Firm*—Nixon & Vanderhye

[57] ABSTRACT

The invention relates to preformed, shaped, refractory, heat-insulating articles for use in an expendable sidewall lining of a molten metal handling vessel. The lining has a face at part of which is exposed a zone of matter of high resistance to erosion by molten metal and accompanying slag. The vessel may be e.g. a tundish for use in the continuous casting of molten metal e.g. steel.

20 Claims, 2 Drawing Sheets

REFRACTORY, HEAT INSULATING ARTICLES

Figure 1:
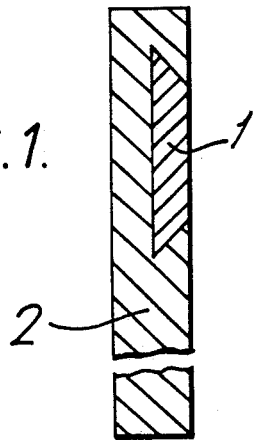

The invention relates to refractory, heat-insulating articles, to molten metal handling vessels lined with such articles and to the use of such vessels.

In the continuous casting of metals, e.g. steel, molten metal is poured from a ladle into a continuous casting mould via an intermediate vessel which acts as a constant head reservoir and is called a tundish. The tundish has a metal floor and sidewalls and one or more outlet nozzles set in the floor or a sidewall. To protect the metal floor and walls of the tundish from the effects of molten metal it is usual to line the interior of the tundish with a relatively permanent lining, often made of bricks. The tundish may additionally be provided with an inner, expendable lining of refractory, heat-insulating slabs. This is described in U.K. patent specification No. 1364665 and is highly advantageous.

Although the expendable lining described above is intended to be expendable, it needs to survive satisfactorily for the duration of a cast and this may involve the passage of more than one ladleful of metal through the tundish, a practice known as sequence casting. The lining needs to withstand not only the temperature of the molten metal but also erosion by the metal and any slag associated with it.

To extend the usefulness of expendable tundish linings much work has been done over the years to enhance the erosion resistance of the linings. Enhanced erosion resistance has been achieved in various ways e.g. by increasing the density of the linings and/or by use of materials e.g. graphite that lead to enhanced erosion resistance. Improvements in erosion resistance have been accompanied by increased thermal capacity and conductivity and these consequences have been accepted as inevitable and tolerated for the sake of the improved erosion resistance.

According to the invention a preformed, shaped, refractory, heat-insulating article for use in an expendable sidewall lining of a molten metal handling vessel has a face at part of which is exposed a zone of matter of high resistance to erosion by molten metal and accompanying slag.

In molten metal handling vessels some areas are more subject to erosion than others and, in particular, areas that come into contact with molten slag are more inclined to be eroded than areas which only come into contact with molten metal. Use of articles of the invention enables molten metal handling vessels to be provided with expendable linings having a valuable combination of erosion resistance properties and other properties e.g. thermal capacity and conductivity properties.

During continuous casting the level of molten metal in the tundish usually changes relatively little and thus the same area of the sidewall lining is in prolonged contact with slag on the surface of the molten metal and is therefore particularly subject to erosion. Articles of the invention in the form of slabs are particularly advantageous for lining tundish sidewalls and for this purpose the high erosion resistance zone of the slab is at or near the upper end of the slab in use. The uppermost part of the slab in use is usually subject to little or no contact with molten metal and slag and thus it is generally preferred that the high erosion resistance zone of the slab should be somewhat spaced from the upper edge of the slab in use.

Part of the article maybe of lower specific heat and thermal conductivity than the high erosion resistance zone which can be of great value in that it enables advantageous thermal properties to be achieved in those areas of the lining where these properties are particularly important. When molten metal is initially introduced into a molten metal handling vessel, the hot metal is chilled by contact with the colder lining and, even if the thermal properties of the lining are subsequently adequate, the initial chilling of the metal can lead to problems. For example, in the case of tundishes the initial chilling can lead to difficulties at the start of casting and require special measures to be taken in preparing the tundish for use and/or require supplying the metal at a higher temperature. As the molten metal initially introduced contacts first the lining of the base of the vessel and the lower part of the sidewall lining, the thermal properties of these parts of the lining are particularly important in relation to the initial chilling effect. Accordingly, sidewall lining slabs according to the invention in which the lower part in use is of relatively low specific heat and thermal conductivity enable the initial chilling effect to be kept low and such slabs are particularly useful in tundishes.

Alternatively, in circumstances where the initial chilling effect is not a particular problem or the lining is preheated before introduction of the molten metal into the tundish, the part of the face other than the high erosion resistance zone may be of higher specific heat and thermal conductivity than the zone.

Other factors which influence the form which tundish lining slabs of the invention may have are related to the steelmaking practice in use at the steelworks where the slabs are used.

In some instances a low viscosity slag may be used as a cover for the molten steel in a tundish for the purpose of removing deleterious alumina inclusions from the steel. Such low viscosity slags generally have a high residual level of sodium oxide present which reacts with sidewall lining slabs, containing as principal fillers, magnesite, silica and olivine or mixtures of these, causing severe erosion in a short time period at the slag/slab reaction interface. Failure of the slabs in this way is most disadvantageous since the slabs will need replacement thus interrupting the continuous casting sequence which is clearly undesirable.

Other types of slags encountered in a tundish which are particularly troublesome from the point of view of rapid erosion of the sidewall lining slabs at the slab/slag interface are lime-fluorspar slags carried over into the tundish i.e. generally not deliberately added as a covering slag by a steelmaker, but present in the tundish as a result of the secondary ladle steelmaking process and high manganese oxide containing slags which are often encountered in a tundish when the steel therein is produced using a basic oxygen process.

In each case the articles according to the invention are formed with the high erosion resistant zone exposed at the face destined to face the molten metal. The zone may have the following characteristics:

(i) a higher density than the density of the matter at the remainder of the face of the article where both are formed from substantially the same composition especially having regard to the refractory filler content and types: or (ii) a higher density than the remainder of the matter at the face of the article where the zone is formed of a different composition from the remainder of the face especially having regard to the refractory filler content and type: or (iii) a lower density than the remainder of the face where the zone is formed of a different composition from the remainder of the face having regard to the refractory filler content and type.

In articles of the invention the high erosion resistance zone is exposed at a face of the article but it is generally preferred that this zone should not extend throughout the thickness of the article.

An advantage of the articles of the invention is that compared with articles composed wholly of dense material of high erosion resistance the articles can be made with lower overall densities, thereby rendering handling of the articles easier. Moreover, material of relatively low specific heat and thermal conductivity is generally more permeable than material of high erosion resistance and this aids escape through the lining rather than into the molten metal of any deleterious gases formed as a result of the metal contacting the lining. Furthermore the inclusion of the high erosion resistance zone may enable suitable properties to be achieved with thinner, and therefore lighter and more easily handled, articles.

The high erosion resistance zone of an article of the invention may comprise refractory filler and binder. Examples of suitable refractory fillers are silica, olivine, alumina, aluminosilicates and chromite. Preferably the refractory filler comprises one or more of calcined magnesite, calcined bauxite, corundum and zircon. The binder may be organic and/or inorganic. Examples of suitable organic binders are phenol-formaldehyde, urea-formaldehyde resins and starches. If organic binder alone is used the amount is preferably 3 to 6% by weight. Examples of suitable inorganic binders are silicates, especially sodium silicate, and phosphates. Inorganic binder if used is preferably present in an amount of 3 to 12% by weight.

The high erosion resistance zone may be made by a slurry-forming technique i.e. an aqueous slurry of the ingredients is de-watered in a suitably shaped permeable mould and the product then heated to dry it and render the binder effective. If the zone is made by a slurry-forming technique, it preferably contains inorganic fibre, e.g. calcium silicate fibre, fibreglass and aluminosilicate fibre, preferably in an amount of 0.2 to 5% by weight. Alternatively, the high erosion resistance zone may be made by ramming a damp mixture of its ingredients into a suitable mould or former or into a recess formed in the face of the article.

The erosion resistant zone may also be made by casting a pourable slurry or paste of the ingredients comprising a cementitious binder into a suitable mould or former and allowing the slurry or paste to set. As above, the casting of the zone can be into a recess formed in the face of the article. The ingredients for casting in the manner prescribed above may comprise a high purity source of alumina e.g. corundum or aluminosilicate e.g. bauxite and a high-alumina cement.

The other part or parts of the article may also comprise refractory filler and binder and the same or different refractory fillers may be used and the same binders may be used. Lightweight refractory fillers e.g. expanded perlite may be included e.g. in amounts of 2 to 8% by weight. The part is preferably made by a slurry-forming technique and may contain 0.5 to 3% of organic fibre e.g. scrap paper. Inorganic fibre is preferably present if there is no organic fibre and may be present in any event e.g. in amounts of 2 to 8% by weight. Suitable inorganic fibres include calcium silicate fibre and fibreglass.

The formation of the high erosion resistance zone and the remainder of the face have been separately described above but it is in fact preferred to form the zone first and then form the rest of the face around it. In particular in the case where all the components are formed from aqueous slurries it is preferred to form the high erosion resistance zone first, (but not to heat it to dry it and render the binder effective) and then to form the material of the rest of the face around the already formed zone and heat the article to dry it and render the binder effective throughout the article. As an alternative after formation of the high erosion resistance zone, this zone may be heated to dry it and render the binder effective and the rest of the face then formed around the high erosion resistance zone in a "keying" relationship and heated to dry it and render the binder effective. Similarly, the cement bonded material may be preformed and the face formed around it in a "keying" relationship. Furthermore, the preformed high erosion resistance zone may be adhered to the face of an article according to the invention by any suitable means e.g. a refractory cement or adhesive.

An article according to the invention may be formed which comprises a facing layer at the surface of which the zone is exposed and a backing layer of lower specific heat and thermal conductivity than that of the facing layer.

According to a further aspect of the invention a molten metal handling vessel has an expendable sidewall lining comprising one or more articles of the invention so positioned that the high erosion resistance zone faces into the vessel.

Whilst the invention has been described chiefly in relation to tundishes, the articles of the invention may be used in other molten metal handling vessels e.g. ladles. The invention is particularly valuable in relation to ferrous metals e.g. steel and iron. The vessel may be a tundish for continuously casting steel or a ladle for making iron or steel castings by pouring the molten metal into a mould from the ladle.

Figure 2:
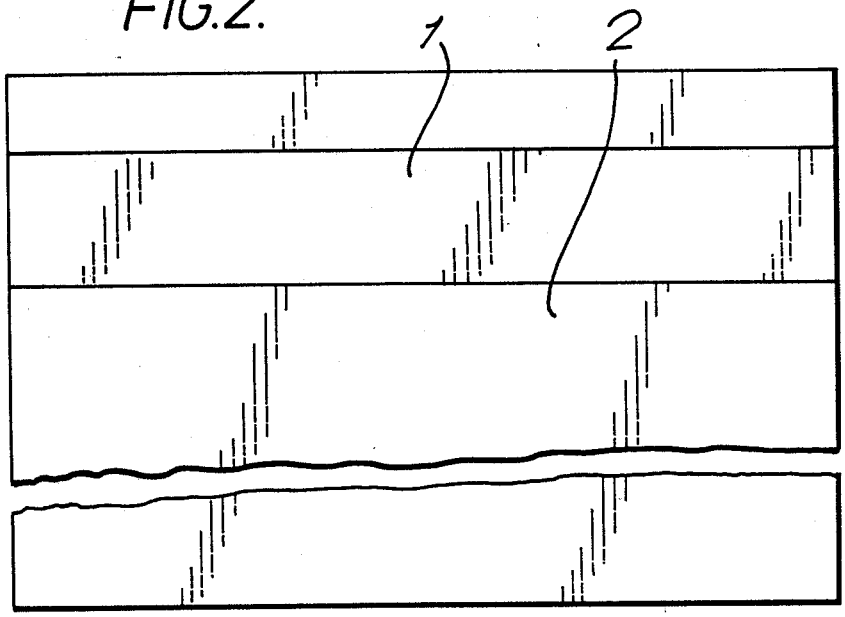
Figure 3:
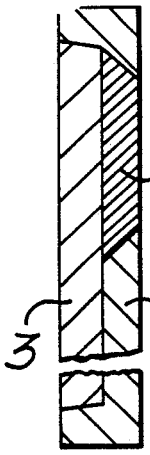
Figure 4:
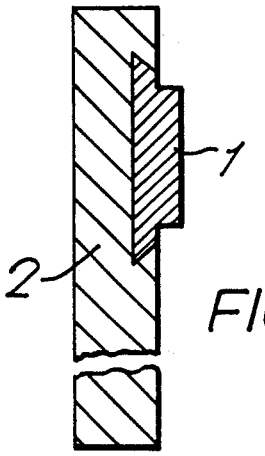
Figure 5:
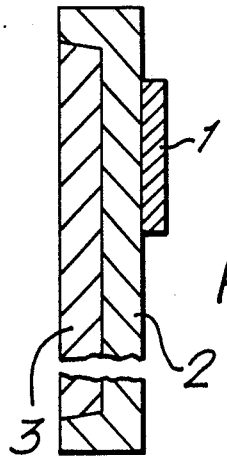

The invention is further described with reference to the accompanying drawings in which:

FIG. 1 is a vertical section through a slab of the invention for lining the sidewall of a tundish, FIG. 2 is an elevation of the inward facing face of the slab of FIG. 1, FIG. 3 is a vertical section through a multi-layer slab of the invention for lining the sidewall of a tundish, FIG. 4 is a vertical section through a slab of the invention for lining the sidewall of a tundish of which part of the high erosion resistance zone extends into the interior of a tundish in use, FIG. 5 is a vertical section through a two layer slab of the invention for lining the sidewall of a tundish of which the higher erosion zone is adhered to the face of the facing layer of the slab.

The slab of FIGS. 1 and 2 has a zone 1, of high resistance to erosion by molten metal and accompanying slag, towards the upper end of the inner face of the slab and the remainder of the slab is a part 2 of lower specific heat and thermal conductivity than the zone 1.

The slab of FIG. 3 has a zone 1 of high resistance to erosion by molten metal and accompanying slag, towards the upper end of the inner face of the slab and the remainder of the inner face is a part 2 of the same composition as zone 1 but having a lower density and behind part 2 is a different composition of highly heat-insulating material 3.

In FIG. 4 a slab is shown which has a zone 1 formed of a preformed castable cementitious composition partly in a recess formed in the remainder 2 of the slab.

In FIG. 5 a slab is shown which has a zone 1 formed of a preformed castable cementitious composition adhered to the face 2 of a two layer slab having a backing layer 3 by means of a refractory cement.

Examples of suitable compositions for the high erosion resistance zone are as follows:

| | Ingredient | % by weight |
|---|---|---|
| 1 | calcined magnesite | 91.5 |
| | boric acid | 0.5 |
| | calcium silicate fibre | 3.0 |
| | scrap paper | 1.0 |
| | phenol-formaldehyde resin | 4.0 |
| 2 | zircon sand | 55.2 |
| | calcined bauxite | 30.8 |
| | calcium silicate fibre | 2.5 |
| | scrap paper | 1.5 |
| | phenol-formaldehyde resin | 3.0 |
| | urea-formaldehyde resin | 1.5 |
| | fibreglass | 0.5 |
| | sodium silicate ($SiO_2$ :$Na_2O$ ratio 3.37:1) | 5.0 |
| 3 | calcined magnesite | 85.0 |
| | carbon (electrode scrap) | 10.0 |
| | sodium hexametaphosphate | 4.0 |
| | aluminosilicate fibre | 1.0 |

Compositions 1 and 2 may be formed by slurry-forming techniques to give shapes having densities of 1.7 and 1.6 $g.cm^{-3}$ respectively whilst composition 3 can be formed into a shape of density 2.1 $g.cm^{-3}$ by a ramming technique.

Examples of suitable castable cementitious compositions for the high erosion resistance zone are as follows:

| | Ingredient | % by weight |
|---|---|---|
| 4 | alumina (corundum) | 83.0 |
| | calcium-aluminate cement | 17.0 |
| 5 | aluminosilicate (andalusite) | 72.0 |
| | alumina (corundum) | 11.0 |
| | calcium-aluminate cement | 17.0 |
| 6 | alumina | 86.0 |
| | silica | 4.0 |
| | calcium-aluminate cement | 10.0 |

Compositions 4, 5 and 6 were formed by the addition of sufficient water to form a pourable slurry or paste and allowed to set for 24 hours in a former or mould, to give shapes. The shapes when subsequently dried at 110° C. for 2 hours and heated to 600° C. and cooled to ambient over an extended period had a density of 3.0 $g.cm^{-3}$, 2.4 $g.cm^{-3}$ and 3.4 $g.cm^{-3}$ respectively.

Examples of suitable compostiions for the remainder of the face are as follows:

| | Ingredient | % by weight |
|---|---|---|
| A | calcined magnesite | 82.5 |
| | ball clay | 5.75 |
| | phenol-formaldehyde resin | 4.0 |
| | scrap paper | 2.5 |
| | expanded perlite | 4.75 |
| | boric acid | 0.5 |
| B | calcined magnesite | 75.3 |

-continued

| Ingredient | % by weight |
|---|---|
| silica sand | 15.0 |
| starch | 3.0 |
| calcium silicate fibre | 3.0 |
| fibreglass | 0.2 |
| urea-formaldehyde resin | 1.5 |
| scrap paper | 2.0 |

Compositions A and B may be formed by slurry-forming techniques to give shapes having densities of 1.15 and 1.4 $g.cm^{-3}$ respectively.

In the case where the part of the article other than the zone comprises a plurality of layers, the backing layer may be formed of the following highly heat-insulating composition:

| Ingredient | % by weight |
|---|---|
| olivine | 84.2 |
| paper | 6.3 |
| phenol-formaldehyde resin | 3.2 |
| slag wool | 6.3 |

The density of the above slurry-formed composition after drying for 4 hours at 180° C. was 0.87 $g.cm^{-3}$.

We claim:

1. A preformed, shaped, refractory heat insulating article for use as an expandable sidewall lining of a molten metal handling vessel, said article having first and second major faces, and a plurality of edge faces defining collectively said major faces, the area of each of said major faces being much larger than that of said edge faces; and said first major face adapted to contact molten metal, while said second major face, and most portions of said edge faces, are not adapted to contact molten metal; said first major face including a first part formed of a low specific heat and low thermal conductivity material, and a second part formed of a different material than the material of the first part, said material of the second part having a higher erosion resistance to molten metal and slag than the material of the first part.

2. An article according to claim 1 wherein said first major face is defined by a linear edge, and wherein said material of said second part is disposed in a zone having first and second edge portions, each of said edge portions being essentially linear and essentially parallel to, and spaced from, said linear edge, the rest of said article beside said second part being formed of material of said first part.

3. An article according to claim 1 wherein said second part comprises a small zone within said first part, said zone extending less than the entire thickness of said article.

4. An article according to claim 1 wherein said material of said first part has a lower specific heat and lower thermal conductivity than the material of said second part.

5. An article as recited in claim 1 wherein said material of said second part has a higher density than said material of said first part.

6. An article according to claim 1 further comprising a third part comprising a backing layer for backing said first part and said second part, the material of said third part having a lower specific heat and lower thermal conductivity than the material of said first part, and said material of said second part having a higher erosion resistance to molten metal and slag than the material of said third part.

7. An article according to claim 1 wherein the material of the second part comprises one or more refractory filler materials selected from silica, olivine, alumina, aluminosilicates, chromite, calcined magnesite, calcined bauxite, corundum and zircon.

8. An article according to claim 1 wherein the material of the second part comprises one or more binding agents selected from phenol-formaldehyde resins, urea-formaldehyde resins, starches, phosphates, silicates and calciumaluminate cements.

9. An article according to claim 1 wherein the material of the second part is wholly or partly in a recess in the first major face of the article.

10. An article according to claim 1 wherein the material of the second part is formed by a slurry-forming technique.

11. An article according to claim 10 wherein the remainder of the article is formed by a slurry-forming technique.

12. An article according to claim 1 wherein the material of the second part is of refractory, cast, cement-bonded material.

13. An article according to claim 12 wherein the remainder of the article is formed by a slurry-forming technique.

14. A molten metal handling vessel having a top and a bottom, and sidewalls, and having an expendable sidewall lining comprising at least one article, said article comprising a preformed, shaped, refractory heat insulating article having a face having a first part formed of a low specific heat and thermal conductivity material, and having a second part formed of a different material than the material of said first part, said material of the second part having a higher erosion resistance to molten metal and slag than the material of the first part; said article disposed within said vessel so that at least a portion of said first part and a portion of said second part face into the vessel and said material of the second part extends essentially continuously generally horizontally across the width of said article.

15. A vessel as recited in claim 14 wherein said material of said second part extends essentially linearly, and horizontally, and wherein said at least one article comprises a plurality of articles each having a said second part of high erosion resistance material, said parts of erosion resistance material forming a generally horiontally extending zone around the entire internal perimeter of said vessel.

16. A molten metal handling vessel according to claim 14 wherein the vessel is a metallurgical ladle.

17. A molten metal handling vessel according to claim 14 wherein the vessel is a continuous casting tundish.

18. A preformed, shaped, refractory heat insulating article for use as an expendable sidewall lining of a molten metal handling vessel, said article having a face including a first part formed of a low specific heat and low thermal conductivity material, and a second part formed of a different material than the material of the first part, said material of the second part having a higher erosion resistance to molten metal and slag than the material of the first part; and wherein the material of the second part is wholly or partly in a recess in the face of the article.

19. A preformed, shaped, refractory heat insulating article for use as an expendable sidewall lining of a molten metal handling vessel, said article having a face including a first part formed of a low specific heat and low thermal conductivity material, and a second part formed of a different material than the material of the first part, said material of the second part having a higher erosion resistance to molten metal and slag than the material of the first part; and wherein said second part comprises a small zone within said first part, said zone extending less than the entire thickness of said article.

20. A preformed, shaped, refractory heat insulating article for use as an expendable sidewall lining of a molten metal handling vessel, said article having a face including a first part formed of a low specific heat and low thermal conductivity material, and a second part formed of a different material than the material of the first part, said material of the second part having a higher erosion resistance to molten metal and slag than the material of the first part; and further comprising a third part comprising a backing layer for backing said first part and said second part, the material of said third part having a lower specific heat and lower thermal conductivity than the material of said first part, and said material of said second part having a higher erosion resistance to molten metal and slag than the material of said third part.

* * * * *

UNITED STATES PATENT AND TRADEMARK OFFICE

CERTIFICATE OF CORRECTION

PATENT NO. : 4,900,603

DATED : February 13, 1990

INVENTOR(S) : BOILY et al

It is certified that error appears in the above-identified patent and that said Letters Patent is hereby corrected as shown below:

Column 6, line 29 delete "expandable" and replace by --expendable--

Signed and Sealed this

Nineteenth Day of February, 1991

*Attest:*

HARRY F. MANBECK, JR.

*Attesting Officer*

*Commissioner of Patents and Trademarks*